United States Patent [19]

Akao et al.

[11] Patent Number: 4,872,431

[45] Date of Patent: Oct. 10, 1989

[54] INTERNAL COMBUSTION ENGINE WITH CERAMICS VALVES

[75] Inventors: Shigeaki Akao; Noboru Ishida; Mitsuyoshi Kawamura, all of Aichi, Japan

[73] Assignee: NGK Spark Plug Co., Ltd., Nagoya, Japan

[21] Appl. No.: 186,841

[22] Filed: Apr. 27, 1988

[30] Foreign Application Priority Data

Apr. 28, 1987 [JP] Japan ..... 62-65071[U]

[51] Int. Cl.[4] ..... F01L 3/00

[52] U.S. Cl. ..... 123/188 AA; 123/315; 123/90.23; 123/432

[58] Field of Search ..... 123/315, 90.23, 432, 123/188 AA

[56] References Cited

U.S. PATENT DOCUMENTS

| | | | |
|---|---|---|---|
| 4,385,598 | 5/1983 | Nakajima et al. | 123/432 |
| 4,519,364 | 5/1985 | Enomoto et al. | 123/432 |
| 4,530,322 | 7/1985 | Yamada et al. | 123/188 AA |
| 4,660,529 | 4/1987 | Yoshikawa | 123/315 |

FOREIGN PATENT DOCUMENTS

| | | |
|---|---|---|
| 84685 | 7/1921 | Austria . |
| 1476045 | 2/1969 | Fed. Rep. of Germany . |
| 967697 | 8/1964 | United Kingdom . |

OTHER PUBLICATIONS

"Automotive Engineering", *Ceramic in an Engine,* Issue 12 of 1986, p. 372.

*Primary Examiner*—E. Rollins Cross

*Attorney, Agent, or Firm*—Foley & Lardner, Schwartz, Jeffery, Schwaab, Mack, Blumenthal & Evans

[57] ABSTRACT

An internal combustion engines comprises at least one exhaust valve made of ceramics per each engine cylinder and a plurality of intake valves made of steel. The relation in number and valve head diameter between the intake and exhaust valves is designed so as to give Pe<Pi and De>Di where Pe is the number of exhaust valves per each engine cylinder, Pi is the number of intake valve per each engine cylinder, De is the valve head diameter of the exhaust valves and Di is the valve head diameter of the intake valve.

2 Claims, 1 Drawing Sheet

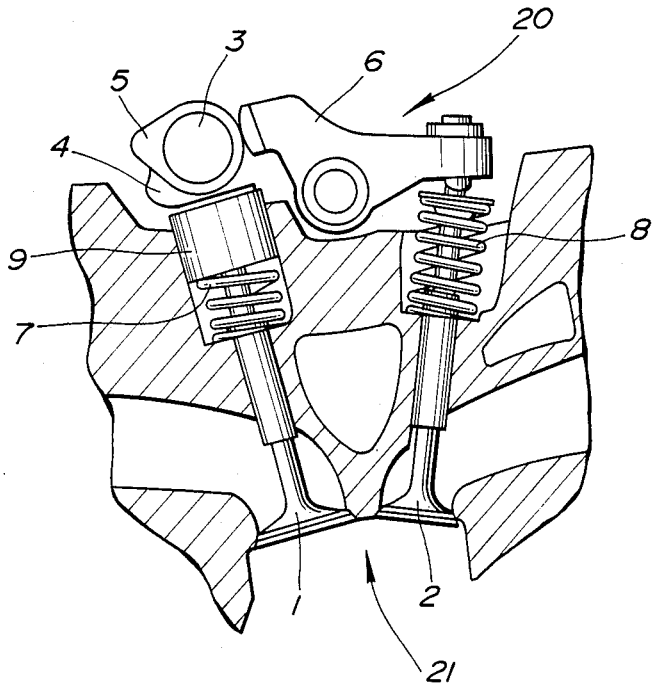
20
3
6
5
4
8
9
7
1
2
21

INTERNAL COMBUSTION ENGINE WITH CERAMICS VALVES

BACKGROUND OF THE INVENTION

1. Field of the Invention

The present invention relates to an internal combustion engine, particularly of the high output type.

2. Description of the Prior Art

Internal combustion engine intake and exhaust valves have heretofore been made of heat resisting steel. It is a usual practice to provide each engine cylinder with two valves, i.e., one intake valve and one exhaust valve. However, in some internal combustion engines for automotive vehicles or autobicycles, each engine cylinder is provided with more than three valves in order to attain a high output and a high operating efficiency.

It has recently been tried to utilize valves made of ceramics for reducing the weight of the valve train and thereby improving the responsiveness and increasing the maximum output and the operating efficiency.

The engine rpm at which so-called "valve surging" occurs is usually determined by the weight of the heaviest valve. The "valve surging" is a kind of vibration or jumping of a valve resulting from a resonance phenomena of a valve train including a valve, valve spring, tappet, etc. Accordingly, in order to prevent "valve surging" , it is useful to employ the intake valve or valves made of ceramics. The intake valve or valves made of ceramics are designed to be larger than the exhaust valve or valves.

However, if the intake valve or valves made of ceramics should chip, the chipped piece or pieces would enter another cylinder to break the valves thereof, thus resulting in a high possibility of the engine becoming inoperative. Accordingly, it is undesirable for safety reason to employ the intake valve or valves made of ceramics.

SUMMARRY OF THE INVENTION

In accordance with the present invention, there is provided an improved internal combustion engine which comprises at least one exhaust valve made of ceramic per each cylinder and a plurality of intake valves made of steel per each engine cylinder. The relation in number and valve head diameter between the intake and exhaust valves is designed so as to give $Pe<Pi$ and $De>Di$ where Pe is the number of the exhaust valves per each cylinder, Pi is the number of the intake valve per each cylinder, De is the valve head diameter of the exhaust valves and Di is the valve head diameter of the intake vavle.

The above structure is effective for solving the above noted problems inherent in the prior art device.

It is accordingly an object of the present invention to provide an improved internal combustion engine which can produce an increased output without causing reduction of the engine rpm at which "valve surging" occurs.

It is another object of the present invention to provide an improved internal combustion engine which is highly reliable in operation.

It is a further object of the present invention to provide an improved internal combustion engine which is suited for mass production and can provide a balanced responsiveness between the intake and exhaust valves.

It is a further object of the presnet invention to provide an improved internal combustion engine which can reduce the cost.

BRIEF DESCRIPTION OF THE DRAWING

A single FIGURE is a sectional view of a principlal portion of an internal combustion engine according to an embodiment of the present invention.

DETAILED DESCRIPTION OF THE PREFERRED EMBODIMENT

Referring to the single figure, an engine 20 according to an embodiment of the present invention is an automotive gasoline internal combustion engine having a cylinder 21 of 76mm in cylinder bore or inner diameter.

An exhaust valve 1 is made of silicon nitride (95% of $Si_3N_4$ by weight) and so sized as to be 35mm in valve head diameter and 23g in weight. The exhaust valve 1 is driven by a cam 4 integral with a cam shaft 3 by way of a tappet or lash adjuster 9. An intake valve 2 is made of heat resisting steel and so sized as to be 28mm in valve head diameter and 55g in weight. Two of such intake valves 2 ar provided per each engine cylinder and adapted to be driven by a cam 5 integral with the cam shaft 3. The exhaust valve 1 and the intake valve 2 are adapted to effect valve lifts of 10mm and 8mm, respectively.

The engine 20 was tested to measure the engine rpm at which "valve surging" occurs and the maximum output as shown in table 1. For the purpose of comparison, a modified engines R1 and a prior art engine R2 were tested for measurement of the same factors. The engine R1 is substantially the same as the engine 20 except that the exhaust valves are made of heat resisting steel. The engine R2 is substantially the same as the engine R2 except that the exhaust valves are adapted to effect valve lift of 8mm.

From this table, it will be understood that the engine 20 of this invention can be designed to effect increased valve lift for thereby increasing the maximum output without reducing the engine rpm at which "valve surging" occurs.

From the foregoing, it is to be noted that an important feature of the present invention resides in that the relation in number per each engine cylinder and valve head diameter between intake and exhaust valves is designed to give $Pe<Pi$ (Pe, Pi are positive integers) and $De>Di$ where Pe is the number of exhaust valves per each engine cylinder, Pi is the number of intake valve or valves per each engine cylinder, De is the valve head diameter of exhaust valve and Di is the valve head diameter of intake valve and in that the exhaust valves are made of ceramics whilst the intake valve or vavles are made of metal.

By this structure, the engine rpm at which "valve surging" occurs can be made higher and at the same time the vavle lift of the exhaust valves can be made larger as compared with the case where the exhaust valve of the same size but made of metal is employed together with the valve spring of the same spring constant.

Further, while designing to give $De>Di$ results in reduction of the amount of intake mixture through each intake valve, the total amount of intake mixture necessitated is retained by designing to give $Pe<Pi$. The optimum ratio of one of the valve head diameters De and Di to the other varies depending upon the materials of which the intake and exhaust valves are made. When the intake valve is made of titanium (specific gravity 4.5) and the exhaust valve is made of silicon nitride (specific gravity 3.2), it is optimumly designed so as to give Di =0.9De whereby the valve springs and the spring retainers for the intake and exhaust vavles can be of the same shape and of the same material, contributing to the mass production and effecting a balanced responsiveness between the intake and exhaust valves.

Further, differing from the case where the intake valve or valves are made of ceramics, chipping of the exhasut valves made of ceramics does not cause a serious condition of the engine since the chipped pieces of the exhaust valve or valves can not enter the engine cylinder but are immediately discharged outside of the engine together with the exhaust gases.

Further, it is desirable that the exhaust valves are driven directly by the cams in order to avoid bending stresses applied to the exhaust valves, whereby the reliability is increased. It is further desirable that a single cam shaft is employed to directly drive that exhaust valves while driving the intake valves by way of rocker arms, whereby a power necessary for driving the cam shaft can be reduced as compared with the case of two can shafts and the cost can be reduced.

TABLE 1

| | MAXIMUM OUTPUT (ps) | ENGINE RPM AT WHICH MAXIMUM OUTPUT IS PRODUCED (rpm) | ENGINE RPM AT WHICH VALVE SURGING OCCURS (rpm) |
|---|---|---|---|
| ENGINE 20 | 120 | 6,000 | 6,500 |
| ENGINE R1 | 100 | 5,000 | 5,000 |
| ENGINE R2 | 110 | 5,500 | 6,500 |

What is claimed is:

1. An internal combustion engine comprising:

at least one exhaust valve made of ceramics per each cylinder; and a plurality of intake valves made of metal per each cylinder;

wherein the relation in number and valve head diameter between said intake and exhaust valves are designed so as to give Pe<Pi and De>Di where Pe is the number of said exhaust valves per each cylinder, Pi is the number of said intake valve per each cylinder, De is the valve head diameter of said exhaust valves and Di is the valve head diameter of said intake vavle.

2. An internal combustion engine comprising:

at least one exhaust valve made of ceramics per each cylinder;

a plurality of intake valves made of metal per each cylinder;

a cam shaft with cams; and a rocker arm;

said exhaust valves being driven directly by said cams of said cam shaft;

said intake valves being driven by said cams of said cam shaft by way of said rocker arm;

wherein the relation in number of valve head diameter between said intake and exhaust valves are designed so as to give Pe <Pi and De >Di where Pe is the number of said exhaust valves per each cylinder, Pi is the number of said intake valves per each cylinder, De is the valve head diameter of said exhaust valves and Di is the valve head diameter of said intake valves.

* * * * *